US006866474B2

(12) United States Patent
Uselton

(10) Patent No.: US 6,866,474 B2
(45) Date of Patent: Mar. 15, 2005

(54) NOISE REDUCTION BY VORTEX SUPPRESSION IN AIR FLOW SYSTEMS

(75) Inventor: Robert B. Uselton, Plano, TX (US)

(73) Assignee: Lennox Industries, Inc., Richardson, TX (US)

( * ) Notice: Subject to any disclaimer, the term of this patent is extended or adjusted under 35 U.S.C. 154(b) by 13 days.

(21) Appl. No.: 10/352,298

(22) Filed: Jan. 27, 2003

(65) Prior Publication Data

US 2004/0146395 A1 Jul. 29, 2004

(51) Int. Cl.[7] ..... F04D 29/70

(52) U.S. Cl. ..... 415/121.2; 415/191; 415/208.2; 415/914; 416/247 R

(58) Field of Search ..... 416/247 R; 415/121.2, 415/185, 191, 208.2, 914

(56) References Cited

U.S. PATENT DOCUMENTS

| | | | | |
|---|---|---|---|---|
| 2,080,595 A | | 5/1937 | Anderson et al. | |
| 4,318,669 A | * | 3/1982 | Wennerstrom | 415/914 |
| 4,761,115 A | * | 8/1988 | Hopfensperger | 415/192 |
| 4,886,421 A | * | 12/1989 | Danson | 416/236 R |
| 4,930,729 A | * | 6/1990 | Savill | 244/200 |
| 5,274,201 A | | 12/1993 | Steele | |
| 5,725,427 A | | 3/1998 | Koerber | |
| 6,470,700 B1 | | 10/2002 | Qiu et al. | |
| 6,511,286 B2 | * | 1/2003 | Miyamoto | 416/247 R |

OTHER PUBLICATIONS

Owen, J. C., Bearman, P. W., Passive Control of VIV With Drag Reduction, Journal of Fluids and Structures (2002) pp. 597–605; vol. 15, Department of Aeronautics, Imperial College of Science, Technology and Medicine, London SW7, 2BY, U.K.

* cited by examiner

*Primary Examiner*—Edward K. Look
*Assistant Examiner*—Igor Kershteyn
(74) *Attorney, Agent, or Firm*—Gardere Wynne Sewell LLP

(57) ABSTRACT

Acoustic vibrations generated by von Karman vortex streets are reduced by shaping members interposed in moving air flowstreams, such as fan guards and grilles used in forced flow air conditioning systems, to have either a cylindrical cross section or a non-cylindrical cross-section with non-linear or interrupted leading or trailing edges presented to the air flowstream. Relatively flat rectangular cross-section members with interrupted or non-linear leading or trailing edges formed by somewhat sawtooth or sinusoidal wave forms or connected to spaced apart support members, or cylindrical members formed in the shape of a sawtooth or sinusoidal wave form, or presented with spaced apart rings or grooves interrupting the cylindrical cross-section of the member are typical configurations which exhibit reduced or substantially eliminated acoustic vibrations caused by von Karman vortex shedding.

15 Claims, 8 Drawing Sheets

NOISE REDUCTION BY VORTEX SUPPRESSION IN AIR FLOW SYSTEMS

BACKGROUND OF THE INVENTION

Acoustic vibrations or "noise" perceptible by human beings is a continuing problem in systems where air circulation occurs at moderate to relatively high velocities. For example, forced flow air conditioning systems for commercial and residential applications, of necessity, circulate air by mechanical fans or blowers through enclosures, ductwork and related structures. Human audible noise generated by this air flow is desirably reduced as much as possible, but the practical requirements of air flow systems of the general type mentioned above require air flow velocities and structural features which cause acoustic vibrations perceptible to the human ear. For example, structures such as fan guards or grilles placed over ductwork outlets of various types and over air flow outlets of enclosures for heat exchangers and so-called condenser units in residential and commercial air conditioning systems have been determined to be a source of humanly perceptible noise.

It has been determined that fan guards and similar grille type protective structures associated with forced flow-type air conditioning systems may generate at least some noise as a result of vortex shedding from the downstream side of such structures at certain air flow velocities. Well-known von Karman vortex streets may form at certain air velocities required in air conditioning systems having forced air flow over heat exchangers and for general circulation purposes.

One solution to the problem of von Karman vortex shedding from structures, such as smokestacks and pipelines, is the provision of helical strakes or fins mounted on the exterior of the cylindrical stack or pipeline structure. Although this technique is successful in suppressing formation of von Karman vortex streets, the provision of helical strakes or similar windings in structures associated with forced air flow type air conditioning systems may be somewhat impractical. U.S. Pat. No. 6,470,700 to Qiu, et al. discloses a grille or guard for an air conditioning unit wherein the elongated rod-like members forming the guard are wrapped with wire in a spiral fashion to emulate the wellknown anti-vortex strakes provided on smokestacks, pipelines and similar structures. However, as mentioned above, wrapping the rod-like members of a fan guard or the like with wire poses several problems including increased manufacturing costs, difficulty in cleaning the guard, increased aerodynamic drag and the chance of the wires becoming broken and interfering with operation of equipment placed adjacent to guards, such as an axial flow fan, for example.

Accordingly, there has been a continuing need for further improvements in noise reduction associated with forced flow air handling systems, including forced flow air conditioning systems and the like. It is to these ends that the present invention has been developed.

SUMMARY OF THE INVENTION

The present invention provides means for reducing audible noise generated by air flowing over certain structural elements of an air flow system.

In accordance with one aspect of the present invention, air flow systems which include structures such as fan guards, grilles or similar structures placed over ducts and other enclosures through which a forced flow of air must be conducted, are provided with structural modifications which reduce the formation of and the shedding of vortices on the downstream side of such structural elements. In particular, the invention includes improvements in fan guards or grilles for forced flow air conditioning systems whereby human perceptible noise generated by these structures is measurably reduced.

It has been determined in accordance with the invention that fan guards or grilles used in forced flow air conditioning systems, including outdoor mounted condenser units for vapor compression type air conditioning systems, may be provided with rod or bar-like members forming the grille or guard which are generally of relatively thin rectangular cross section, thus having a relatively high aspect ratio, and connected on their trailing edges, with respect to the direction of air flow thereover, to spaced apart rod like support members, thereby forming trailing edges that are essentially nonlinear or have surface interruptions or the like. In accordance with another feature of the invention, rod or heavy wire-like members making up a grille or fan guard may be provided with undulating, scalloped or somewhat sawtooth shaped leading or trailing edges which have also been determined to reduce or suppress the formation and shedding of vortices from these members when placed in an air flowstream.

Still further in accordance with the invention, it has been determined that guard or protective grille members extending across the flow path of an air flowstream may be formed to have an undulating, shape which may be sinusoidal or sawtooth, for example, and presented to the air flow, at either their upstream, leading edges or downstream, trailing edges which also provides a measurable reduction in audible noise and a shift in the frequency of noise generated by air flow over such members to a lower, less annoying frequency with respect to human perception.

The geometric cross-sections of fan guard or grille members exposed to relatively high velocity air flow may be modified in certain other ways in accordance with the invention with a view to suppressing or preventing formation of von Karman vortex streets and the like. For example, rodlike grille members may have a wavy or undulating shape, overall, thus having a nonlinear leading edge and a nonlinear trailing edge. Accordingly, by presenting a structure exposed to impingement of an air flowstream which appears to have a different cross section shape or diameter at adjacent stations along the structure, a measurable reduction in sound generated by such structures, or at least a shifting of the frequency of the sound from a higher to a lower and less annoying frequency, may be accomplished.

Those skilled in the art will further appreciate the advantages and superior features of the invention upon reading the detailed description which follows in conjunction with the drawings.

DETAILED DESCRIPTION OF THE PREFERRED EMBODIMENTS

Figure 1:
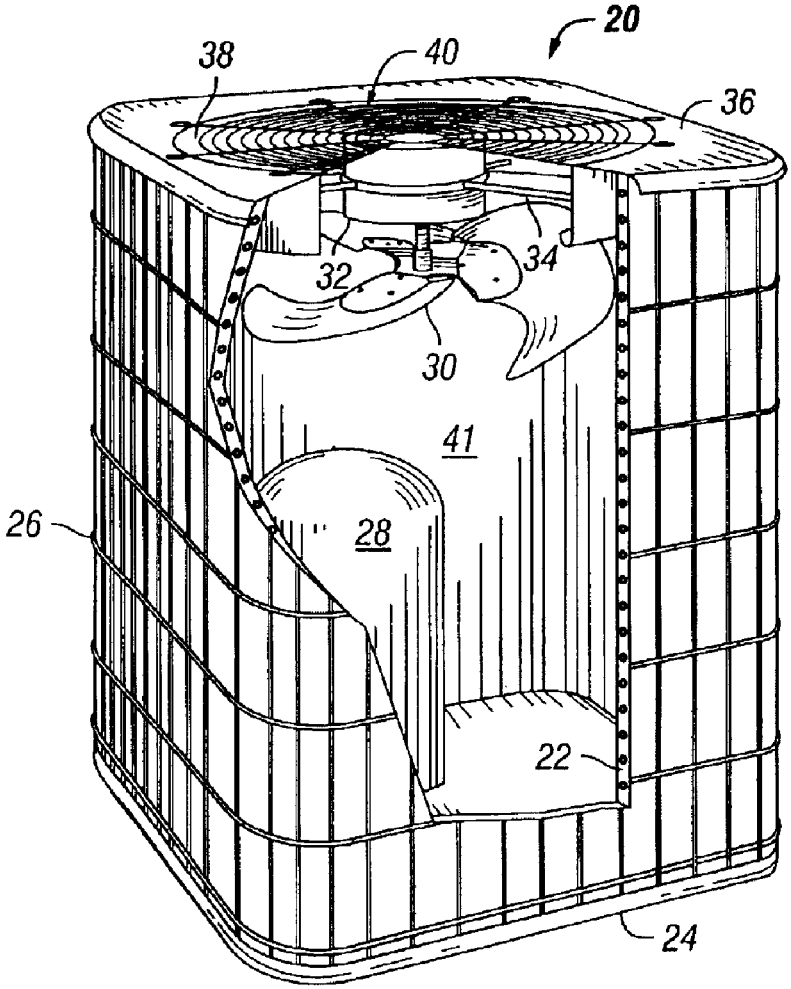
FIG. 1 is a perspective view, partially cutaway, of a condenser unit for a residential or commercial vapor compression type air conditioning system.

In the description which follows like elements are marked throughout the specification and drawings with the same reference numerals, respectively. The drawing figures are not necessarily to scale and certain features may be shown in generalized or somewhat schematic form in the interest of clarity and conciseness.

FIG. 1 illustrates one important component of an air conditioning system in the form of what is known in the art as a condenser unit for a vapor compression type air conditioning system. The condenser unit shown in FIG. 1 is generally designated by the numeral 20 and is characterized by a partial wraparound fin and tube heat exchanger or condenser 22 of a type known in the art. The heat exchanger 22 may also serve as an evaporator in a heat pump system. Heat exchanger of condenser 22 is supported on a generally rectangular base 24 and also enclosed by a wire mesh-like guard structure 26. The condenser unit 20 houses a compressor 28 in a known manner and a motor-driven fan 30 including a suitable electric motor 32. Motor 32 is mounted on suitable support structure including circumferentially spaced radially projecting rods or ribs 34 which extend radially outwardly from the motor 32 and are suitably secured to a top cover 36 for the condenser unit.

A relatively large generally circular opening 38 is formed in the cover 36 and which is covered by a fan guard or grille 40 to prevent debris from falling into the interior space 41 of the condenser unit 20 and to prevent injury to persons possibly otherwise coming into contact with the fan 30 during operation thereof. The fan 30 draws air through the heat exchanger 22 at relatively low velocity, but discharges a forced flow of air through the opening 38 at a relatively high velocity on the order of 1500 to 2500 feet per minute, for example. Thus, the guard structure or grille 40 is directly in the path of air flowing through the opening 38 and has been determined to be a source of human perceptible noise during operation of the condenser unit 20.

It is known that flow of fluid over an elongated object of cylindrical cross-section, will be subject to the generation of disturbances in the flow, commonly known as von Karman vortex streets. Fluid flow conditions generating a Reynolds number generally below 5,000 may produce low pressure zones or vortices on the downstream side of a cylindrical object, for example, which will periodically detach from the object and collapse while new vortices are formed at a relatively high frequency. This periodic vortex formation and shedding phenomena can occur at frequencies which are perceptible to the human ear and thus constitute a source of tonal noise in air flow systems having structures interposed in the air flowstream, including structures such as fan guards, grilles and similar devices placed over ductwork and equipment, such as the condenser unit shown in FIG. 1. Thus, if structures which are necessary in air flowstreams, such as used in forced air flow air conditioning systems, can be constructed to eliminate the vortex formation and shedding phenomena, the overall noise level generated by such structures is reduced.

For example, in an apparatus such as the forced flow air conditioning condenser unit 20 having a fan 30 of approximately 24 inches diameter, it has been determined that a relatively high velocity air flow in the range of 1500 feet per minute to 2500 feet per minute typically occurs in an annular zone having an outside diameter of about 23 inches and an inside diameter of about 15.50 inches. Fan guards or grilles, such as the fan guard 40, are required by industry developed standards and/or governmental regulation to have a spacing between grille or guard members not greater than about 0.50 inches in order to prevent persons from reaching through the grille and suffering damage from contact with a rotating fan.

Figure 2:
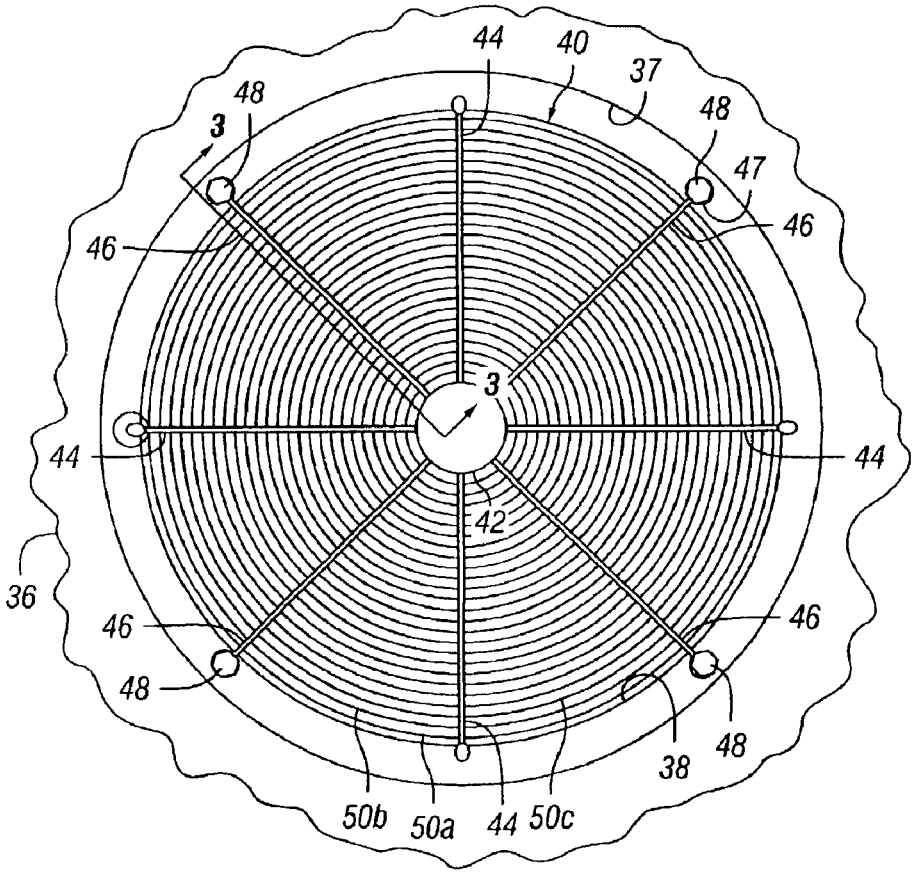
FIG. 2 is a detail top plan view of the condenser unit shown in FIG. 1.

FIG. 2 illustrates a fan guard or grille 40 which is characterized by a circular disk hub 42 and plural circumferentially spaced radially projecting elongated rod-like support members 44 and 46. Four members 44 and four members 46 are shown, and may be evenly or unevenly spaced. At least members 46 are formed with a distal eye part 47, FIG. 2, forming an opening for receiving conventional machine bolts 48, FIG. 3, for securing the fan guard 40 to the cover member 36 at a suitable annular recess 37, see FIG. 3 also. The fan guard 40 is further characterized by circumferential ring-like guard members 50*a*, 50*b*, 50*c* and so on through 50*z* which extend substantially from the radially outermost part of the radial guard members 46 and 44 toward the hub 42. Designations for guard members between 50*c* and 50*z* have been eliminated for purposes of conciseness but such guard members are illustrated in FIG. 2. The guard members 50*a*, 50*b*, 50*c* through 50*z* may be formed as a continuous spiral member as shown by way of example in FIG. 2. However, the members 50*a* through 50*z* may be formed as separate ring-like members of respectively different diameters. A fan guard generally of the type illustrated in FIGS. 2 and 3 might be characterized by radially extending cylindrical cross section rod members corresponding to rod members 44 and 46 having a nominal diameter of 0.25 inches and members corresponding to members 50*a*, 50*b*, 50*c* through 50*z* formed from a continuous cylindrical cross-section steel wire having a diameter of about 0.13 inches. Continuous, spiral wound, circumferential ring-like members, including members 50*a*, 50*b*, 50*c* through 50*z*, as well as the aforementioned ring members, are typically secured to the radial members 44 and 46 by spot welding or the like to form a substantially one piece integral fan guard.

Figure 3:
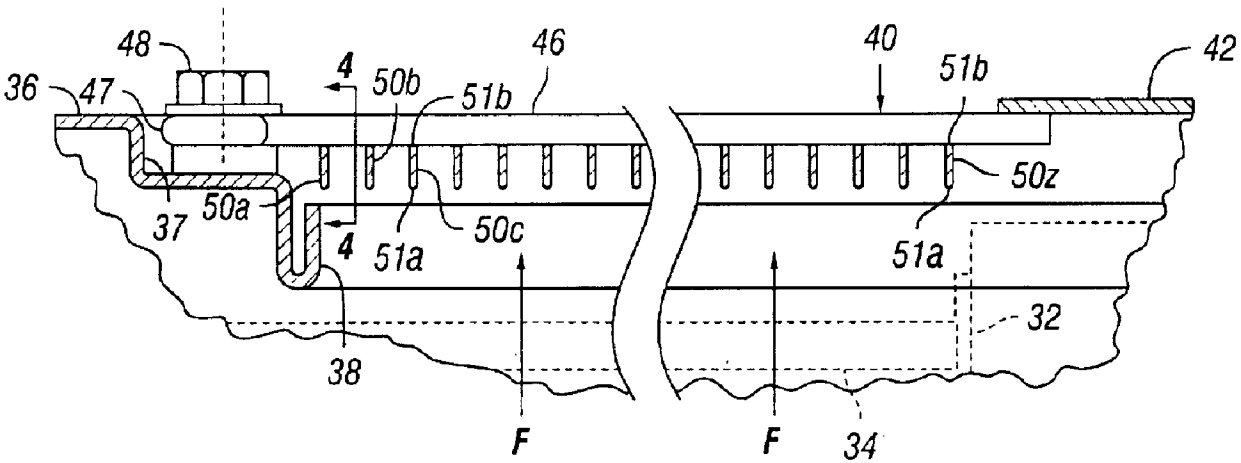
FIG. 3 is a view taken generally from the line 3—3 of FIG. 2.
Figure 15:
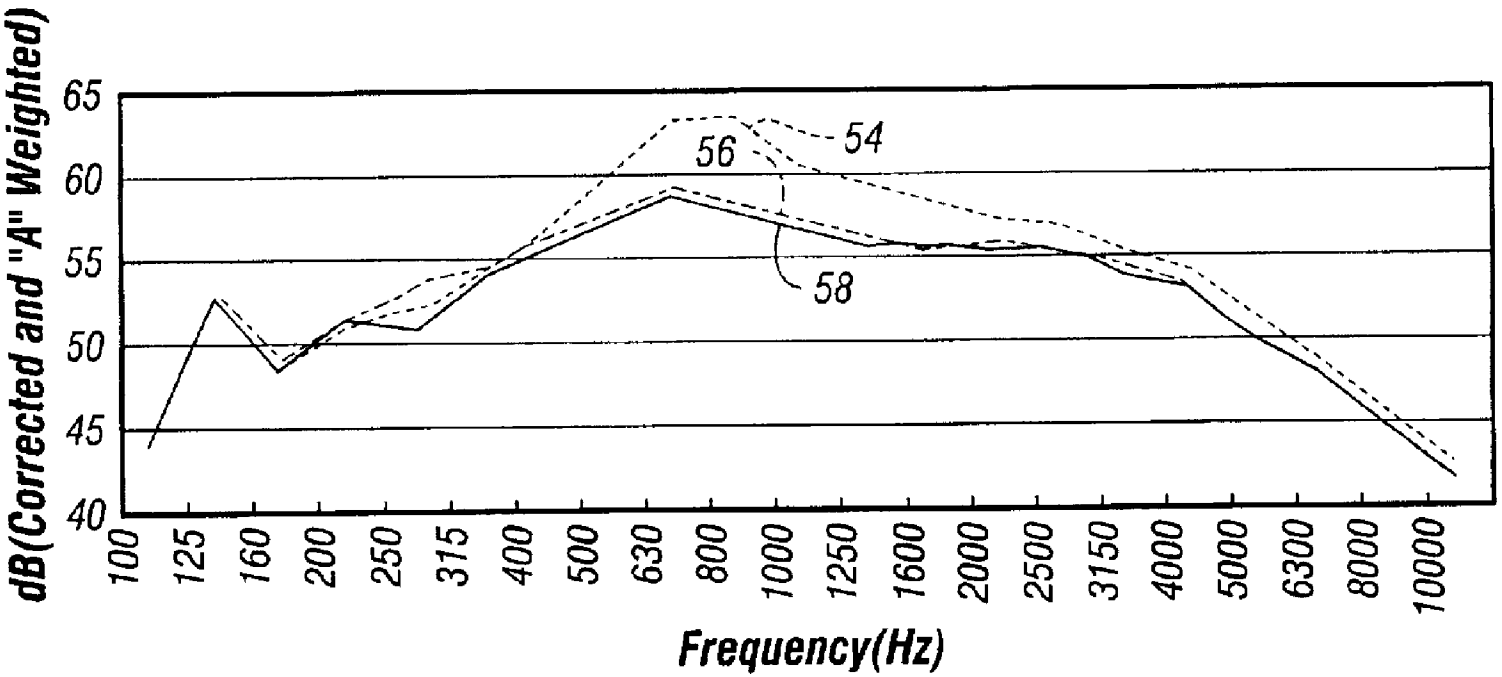
FIG. 15 is a diagram illustrating the effects of fan guard type structures interposed in an air flowstream on sound power level versus frequency.

A fan guard similar to that as described and shown in FIGS. 2 and 3 was tested flowing air over the guard in a range of speeds of 1500 feet per minute to 2500 feet per minute at nominal ambient temperatures in the range of 70° F. to 95° F. at standard sea level pressure conditions to determine sources of noise. FIG. 15 gives an indication of the source of noise at selected frequencies and sound power levels in "A" weighted decibels. In FIG. 15, dashed line curve 54 indicates the sound power level versus frequency for air flowing over a fan guard of the type described above, having cylindrical cross-section radial guard members 44 and 46 and cylindrical cross-section continuous spiral guard members corresponding to guard members 50*a*, 50*b*, 50*c* through 50*z*, but of the diameters mentioned above and operating under the test conditions described above. In the prior art fan guards tested, the radial, circumferentially spaced members corresponding to members 44 and 46 were connected to the leading edge of the cylindrical ring like members. FIG. 15 also illustrates long and short dashed line curve 56 showing the acoustic emissions of a fan guard with only the radial members 44 and 46, and solid line curve 58 indicates the sound power level over the frequency range tested for air flowing through a condenser unit similar to the unit 20 without any fan guard mounted downstream of the condenser cooling fan. Clearly, a fan guard of the type described contributes to acoustic emissions from a forced flow air conditioning condenser unit of the type shown in FIGS. 1 through 3.

Referring again to FIGS. 3 and 4, the guard members 50*a*, 50*b*, 50*c* through 50*z* for the fan guard 40 are formed as rectangular cross-section members, as shown in FIGS. 3 and 4, preferably having a cross-sectional thickness of about 0.062 inches, a width w, as shown in FIG. 4, of about 0.38 inches, and, as mentioned above, with spacing between adjacent members of about 0.44 inches to 0.50 inches. The guard members 50*a*, 50*b*, 50*c* through 50*z* have respective leading edges 51*a* and trailing edges 51*b* with respect to the direction of airflow, indicated by arrow F, thereover. Tests with a fan guard 40 constructed in accordance with FIGS. 3 and 4, as compared with a fan guard of the type mentioned above, and tested at the same conditions as the tests of FIG. 15, indicate an improvement in the form of reduction of acoustic emissions. For example, in FIG. 16 curve 60 represents a fan guard similar to that described above having cylindrical rod radial extending members corresponding to members 44 and 46 and cylindrical cross-section members corresponding to members 50*a*, 50*b*, 50*c* through 50*z* and with the radially projecting circumferentially spaced members disposed upstream of the cylindrical ring or spiral members. Curve 62 represents the acoustic emissions from the fan guard 40. As may be observed from FIG. 16, the higher energy acoustic emissions have been reduced and shifted from a frequency range of about 500 Hz to 1250 Hz to a frequency range of about 200 Hz to 450 Hz, thus reducing the human perceived noise generated by an apparatus, such as the apparatus 20.

Figure 16:
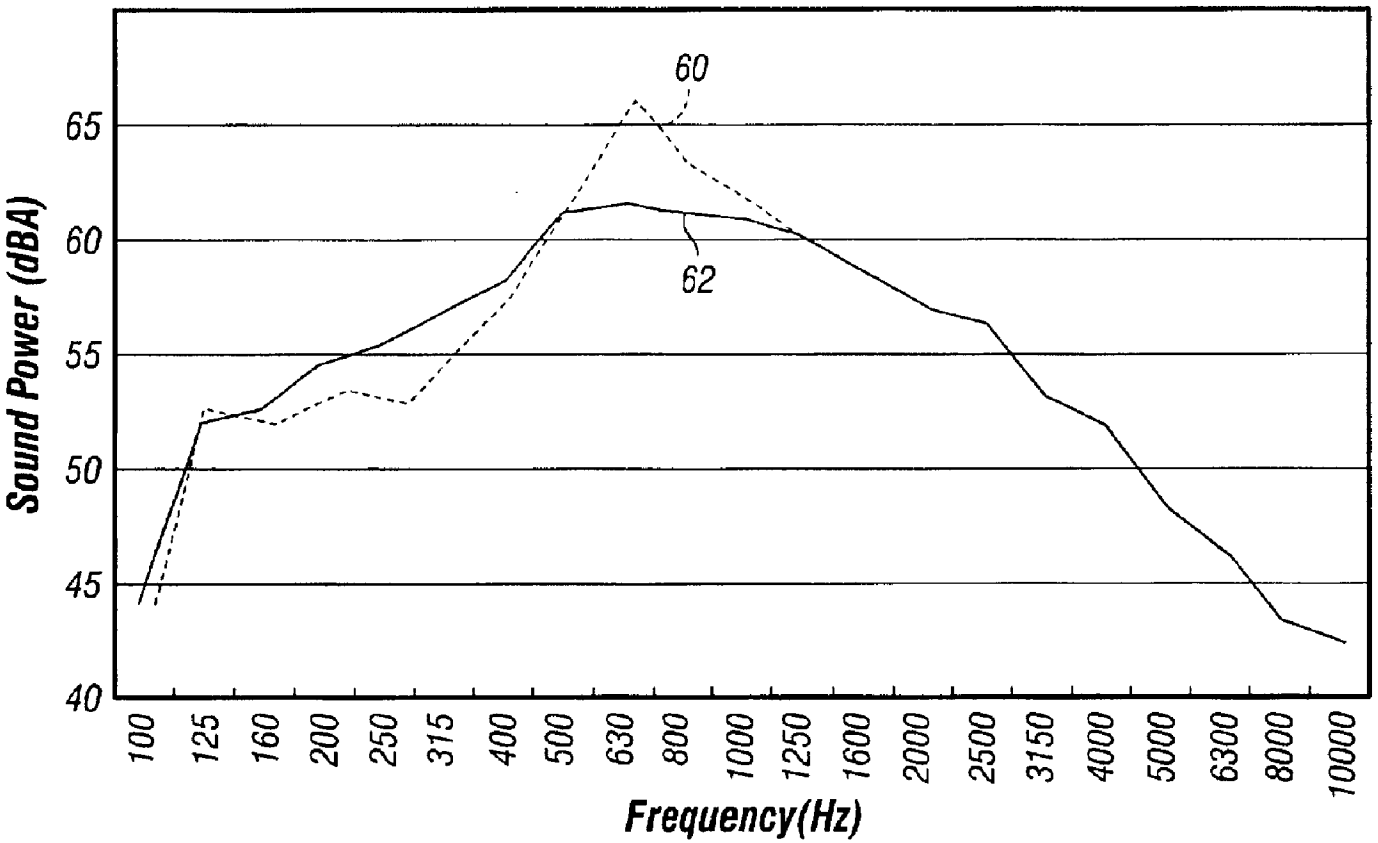
FIG. 16 is a diagram similar to FIG. 15, but illustrating the effect a fan guard of the type illustrated in FIGS. 2 and 3 on sound power level versus frequencies in the human audible range.

Computational fluid dynamic analyses of fan guards or grilles having cylindrical cross-section guard members corresponding to the members 50*a*, 50*b* and 50*c*, at the test conditions stated above, have revealed the generation and shedding of von Karman type vortices, thus resulting in the higher noise levels shown by the curves 54 and 60 of FIGS. 15 and 16. However, analyses of fan guards with members characterized by the member arrangements and cross-section shapes and geometries as shown in FIGS. 2 through 14 have shown that von Karman vortices may be reduced, suppressed or substantially eliminated in the range of air flow conditions stated herein.

Figure 4:
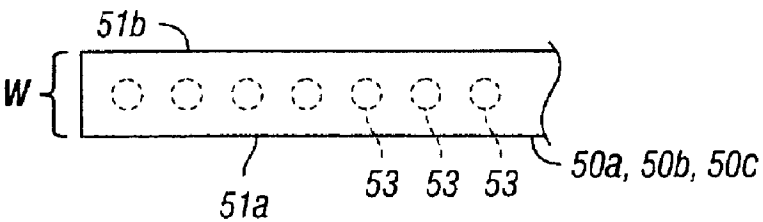
FIG. 4 is a detail view taken generally from the line 4—4 of FIG. 3.

Accordingly, fan guards, grilles and other structural members interposed in air flow systems, such as what is required for a fan guard for a condenser unit such as the unit 20, may be formed as shown in FIGS. 2, 3 and 4. The arrangement of the guard members 50*a*, 50*b*, 50*c* through 50*z* with members 44 and 46 suitably connected thereto on the downstream or trailing edges 51*b* of the members 50*a*, 50*b*, 50*c* through 50*z* provides for interrupted, discontinuous or nonlinear trailing edges of these members with respect to the direction of airflow, as indicated by arrow F in FIG. 3, and is advantageous as indicated. In regard to the configuration of the members 50*a*, 50*b*, 50*c* through 50*z*, as shown in FIG. 4, these members may be further modified by providing spaced apart perforations 53, as shown, which are indicated to further reduce humanly perceptible acoustic emissions from fan guards including this type of member.

Figure 6:
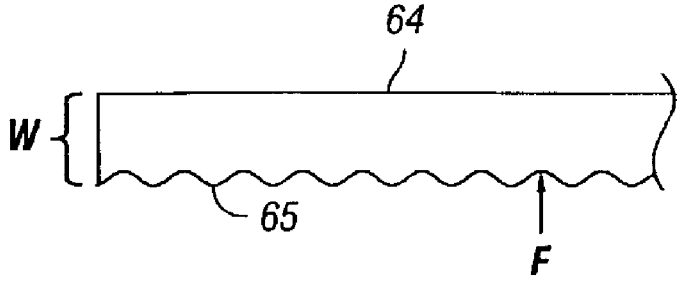
FIG. 6 is a side elevation of a portion of the guard member shown in FIG. 5.
Figure 5:
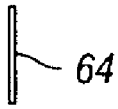
FIG. 5 is an end view of a first alternate embodiment of a guard member for use with a grille or the fan guard illustrated in FIGS. 2 and 3.

Still further, it is indicated from computational fluid dynamic analyses that vortex generation and shedding may be eliminated in airflow systems having a member or members 64, see FIGS. 5 and 6, corresponding to members 50*a*, 50*b* and 50*c*, for example. In member 64 a longitudinal edge of the member comprising a leading edge with respect to the direction of air flow is also nonlinear and is provided with surface interruptions in the form of a sinusoidal wave shape, for example, as indicated by numeral 65 in FIG. 6. The direction of air flow across member 64 is indicated by the arrow F in FIG. 6. Typical advantageous geometries for the scalloped or irregular leading edge 65 may comprise a somewhat sawtooth shape or a sinusoidal waveform having an amplitude of about 0.052 inches and a wavelength of about 0.25 inches for a member having a width w of about 0.375 inches and a thickness of about 0.056 inches, for example.

Figure 6A:
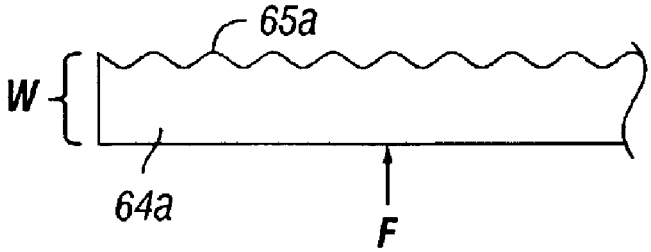
FIG. 6A is a side elevation of a second alternate embodiment of a member for a grille or fan guard in accordance with the invention.

Referring briefly to FIG. 6A, an alternate embodiment of the member 64 is indicated by the numeral 64*a*. Member 64*a* has a trailing edge with respect to the direction of airflow, as indicated by the arrow F, which is interrupted, discontinuous or nonlinear as indicated by the sinusoidal wave shape 65*a* and having the same dimensional characteristics as the wave shape for the member 64. Computational fluid dynamics analysis performed on members having a nonlinear or interrupted trailing edge have indicated improvements in vortex reduction also. The member 64*a* is otherwise like the member 64.

Figure 8:
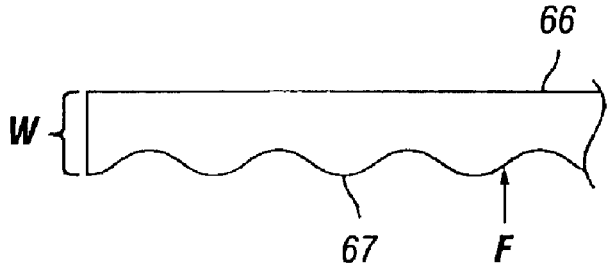
FIG. 8 is a side elevation of a portion of the member shown in FIG. 7.
Figure 7:
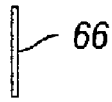
FIG. 7 is an end view of a third alternate embodiment of a member for use with a grille or the fan guard shown in FIGS. 2 and 3.
Figure 8A:
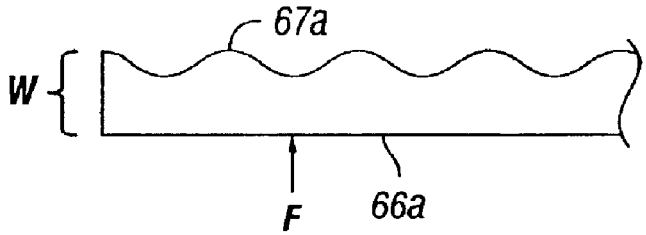
FIG. 8A is a side elevation of a fourth alternate embodiment of a member for a grille or fan guard in accordance with the invention.

Moreover, as shown in FIGS. 7 and 8, another embodiment of a fan guard member, or other structural member which may require to be interposed in an air flow system of the type described herein, is indicated by the numeral 66 having the same width w as the members 50*a* and 64 and a thickness of 0.062 inches. Member 66 has a leading edge also having a somewhat sinusoidal wave shape including an amplitude of about 0.125 inches and a wavelength of about 0.56 inches. Under the same test conditions described above, and in accordance with computational fluid dynamics analyses, a member 66 also exhibits reduced acoustic emissions as compared with a cylindrical cross section rodlike guard member.

Still further, referring to FIG. 6A, another embodiment of a fan guard member showing improved performance is indicated by the numeral 66*a*. The member 66*a* is substantially like the member 66 but an interrupted or nonlinear trailing edge 67*a* is configured with substantially the same wave form as the leading edge of the member 66. Again, computational fluid dynamics analysis of member 66*a* indicates a reduction in the formation and shedding of von Karman vortices.

Figure 9:
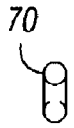
FIG. 9 is an end view of a fifth alternate embodiment of a member for use with a grille or the fan guard shown in FIGS. 2 and 3.
Figure 10:
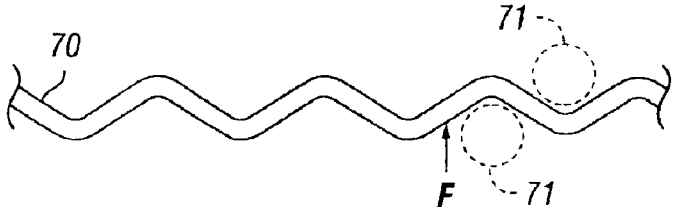
FIG. 10 is a side elevation of a portion of the member shown in FIG. 9.

Computational fluid dynamics analyses were also applied to members having configurations as shown in FIGS. 9 through 14. For example, a cylindrical cross-section guard member 70, as shown in FIGS. 9 and 10, having a diameter of about 0.125 inches and a sawtooth or wavelike configuration, as shown in FIG. 10, with a wavelength of about 0.94 inches and an amplitude of about 0.11 inches, also exhibited, for the test conditions mentioned above, the elimination of von Karman vortex formation and shedding. The shape of member 70 may be achieved, for example, by bending the cylindrical rod cross section shape over cylindrical forms 71 having diameters of about 0.38 inches. Accordingly, for structures desirably requiring cylindrical cross-section members, by presenting a leading edge facing the air flow from direction F, as indicated in FIG. 10, the position of which leading edge varies as shown, vortex generation and shedding may be eliminated also.

Figure 11:
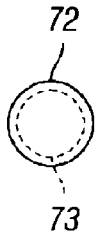
FIG. 11 is an end view of a sixth alternate embodiment of a member for use with a grille or the fan guard shown in FIGS. 2 and 3.
Figure 12:
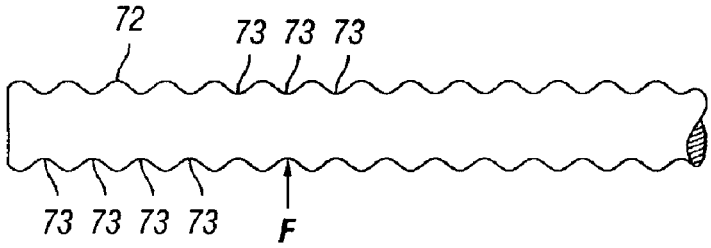
FIG. 12 is a side elevation of a portion of the member shown in FIG. 11.

The present invention contemplates other configurations of members exposed to air flowstreams with respect to eliminating vortex formation and shedding. FIGS. 11 and 12 show a member 72 having a cylindrical cross-section which is interrupted by spaced apart portions 73 of reduced diameter, thus forming circumferential grooves in the otherwise continuous cylindrical outer surface of member 72. Alternatively, the surface interruptions provided by the grooves 73 may, instead, comprise rings of larger diameter than the nominal diameter of member 72. For a member interposed in an air flowstream and having the dimensions mentioned above, such as a nominal diameter of 0.158 inches, grooves 73 may have a width of about 0.088 inches, spacing of about 0.088 inches and formed by reducing the diameter of the rod 72 at the grooves 73 to a diameter of about 0.12 inches.

Figure 13:
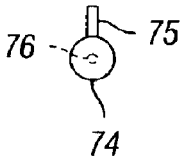
FIG. 13 is an end view of a seventh alternate embodiment of a member for use with a grille or the fan guard shown in FIGS. 2 and 3.
Figure 14:
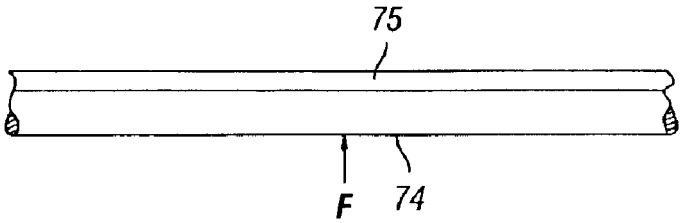
FIG. 14 is a side elevation of a portion of the member shown in FIG. 13.

Still further, computational fluid dynamics analyses of a member 74, as shown in FIGS. 13 and 14, have indicated elimination of von Karman vortex formation and shedding for the flow conditions mentioned above. Member 74 has a somewhat planar tail part or member 75 formed as a flat rectangular cross-section element centered on a plane extending through a central axis 76, FIG. 13, and oriented to be coplanar with the nominal direction of flow of air over the member 74 as indicated by arrow F in FIG. 14. Member 75 may have a thickness of about 0.030 inches and a width of about 0.140 inches for a member 74 having a diameter of about 0.120 inches. Member 75 is also indicated to reduce drag as well as reduce the intensity of von Karman vortex formation and shedding.

Accordingly, computational fluid dynamic simulations carried out for members according to the embodiments of FIGS. 4 through 12 have indicated that the pressure field downstream of such members shows no evidence of the formation of von Karman vortex streets. One explanation for the disruption or elimination of periodic vortex shedding is that, at adjacent stations along the longitudinal axes of the members, a different apparent or effective diameter is presented to the air flowstream by the substantially nonlinear leading edges of the members 64, 66, 70 and 72, for example, or the substantially nonlinear or interrupted trailing edges of members 50*a*, 50*b*, 50*c* through 50*z*, 64*a*, 66*a*, 70, 72 and 74. Moreover, there is a distinct Strouhal frequency related to the effective diameter of a member disposed in an air flowstream. If there is enough variation in the effective diameter between adjacent stations then the viscous coupling between the air flow at the two stations is indicated to prevent establishment of vortex shedding. Moreover, the embodiments of FIGS. 3, 5, 7 and 13 also actually and effectively change the cross section to a non-cylindrical geometry.

Although the configuration of a fan guard or grille member in accordance with FIGS. 9 and 10 shows promise in eliminating vortex shedding, this configuration may not necessarily be the most convenient to use in fabricating a generally circular grille or guard, such as the guard 40. Accordingly, a configuration of guard members such as shown in FIGS. 5 through 8 and, 11 through 14 may be more easily fabricated. In fact, the member 72 of FIG. 12 may be formed with rings of larger diameter at stations 73 rather than the grooves indicated in the drawing figures. The net effect of such a configuration is to give a continuously varying streamwise dimension to the member which influences the frequency at which a von Karman vortex street occurs. Moreover, with regard to the configurations of the members 64 and 66, if the so-called scalloped leading edges 65 and 67 are fine grain enough, that is have a wave length and amplitude pre-selected, vortex shedding at different frequencies cannot occur too close to each other. Thus sound power emitted is reduced and the aerodynamic drag of the members in the air stream is also reduced. Drag reduction is another advantage of the configurations of the members shown in FIGS. 3 through 14 as compared with the formation of helical strakes, such as described above.

The construction or fabrication of members to be disposed in an air flowstream, such as fan guards, grilles and the like, in accordance with the invention, is believed to be within the purview of one of ordinary skill in the art. Materials used for such elements may be conventional engineering materials now used for conventional fan guards and grilles as well as other members interposed in air flow systems, of necessity, since the geometry of the members is a key factor in the improved acoustic performance. For example, the members 44 and 46 of the fan guard 40 and the motor support members 34 for the condensing unit 20 may also benefit from being shaped or configured in a manner similar to the configurations of the members shown in FIGS. 3 through 14 and described hereinabove.

The configurations of the fan guard members described hereinabove may be embodied in certain other members which would be interposed in air flowstreams, including air flowstreams of heating, ventilating and air conditioning equipment. For example, members such as wiring conduits leading to fan motors, such as the motor 32 shown in FIG. 1, and extending across an air flowpath may be configured or modified in accordance with the invention. Still further, certain other types of grilles or fan guards may be configured in accordance with the members described hereinabove. For example, stamped or molded metal or plastic grille structures are often used in air conditioning systems and which are formed to include elongated closely spaced louvers with air flow passages disposed therebetween. Such louvers may also be configured in accordance with the invention to reduce audible "noise" by substantially eliminating the formation of von Karman vortex streets. Moreover, those skilled in the art will appreciate that other structural elements associated with air flowstreams generated by air conditioning systems may be configured in accordance with the present invention.

Although preferred embodiments of the invention have been described in detail herein, those skilled in the art will also appreciate that various substitutions and modifications may be made without departing from the scope and spirit of the appended claims.

What is claimed is:

1. In a forced air flow air conditioning system including an enclosure and a motor driven fan forcing an air flowstream through said enclosure, a protective guard disposed over an opening in said enclosure, said guard including plural spaced apart guard members interposed in said air flowstream, said guard members being configured to have one of leading and trailing edges presented to said air flowstream which are one of interrupted and non-linear and are provided by a repeating pattern at spaced apart stations on said guard members, respectively, to substantially eliminate the formation and shedding of von Karman vortices by said guard members at predetermined conditions of air flow over said guard members.

2. The guard set forth in claim 1 wherein:

said guard members are connected to plural spaced apart support members at spaced apart points on said guard members and at said trailing edges of said guard members, respectively.

3. The guard set forth in claim 2 wherein:

said guard members have a substantially rectangular cross section.

4. The guard set forth in claim 2 wherein:

said guard members are provided with interruptions formed by one of spaced apart projections and grooves formed therein, respectively.

5. The guard set forth in claim 2 wherein:

said guard members are provided with scallops or undulations on said one edge, respectively.

6. The guard set forth in claim 2 wherein:

said guard members have a wavy shape on said one edge.

7. An elongated member purposely interposed in an air flowstream having a predetermined one of a rectangular and cylindrical cross-section shape and one of a leading edge and trailing edge with respect to said air flowstream which is non-linear to substantially eliminate the formation and shedding of von Karman vortices by said member at predetermined conditions of airflow over said member.

8. An elongated member purposely interposed in an air flowstream having a predetermined substantially rectangular cross-section shape and one of a leading edge and trailing edge with respect to said air flowstream which is one of interrupted and non-linear to substantially eliminate the formation and shedding of von Karman vortices by said member at predetermined conditions of airflow over said member.

9. An elongated member purposely interposed in an air flowstream having a predetermined substantially cylindrical cross-section shape and one of a leading edge and trailing edge with respect to said air flowstream which is one of interrupted and non-linear, and said one edge is formed by forming said member to have a wavy shape when viewed in a direction substantially normal to the direction of airflow over said member to substantially eliminate the formation and shedding of von Karman vortices by said member at predetermined conditions of airflow over said member.

10. An elongated member purposely interposed in an air flowstream having a predetermined cylindrical cross-section shape and one of a leading edge and trailing edge with respect to said air flowstream which is one of interrupted and non-linear, said member including at least one of spaced apart rings and grooves interrupting a circumference of said member as presented to said air flowstream to substantially eliminate the formation and shedding of von Karman vortices by said member at predetermined conditions of airflow over said member.

11. A fan guard for a forced airflow air conditioning system, comprising:

plural spaced apart guard members each having one of a cylindrical and rectangular cross-section and a configuration such that at least one of a leading edge and trailing edge of each of said members exposed to an air flowstream flowing over said members is non-linear throughout at least a portion of the length of each of said members to reduce the formation of von Karman vortex streets generally at said trailing edges of said members.

12. A fan guard for a forced airflow air conditioning system, comprising:

plural spaced apart guard members each having a substantially rectangular cross-section and a configuration such that at least one of a leading edge and trailing edge of each of said members exposed to an air flowstream flowing over said members is one of interrupted and non-linear throughout at least a portion of the length of each of said members to reduce the formation of von Karman vortex streets generally at said trailing edges of said members.

13. A fan guard for a forced airflow air conditioning system, comprising:

plural spaced apart guard members each having a substantially cylindrical cross-section and a configuration such that at least one of a leading edge and trailing edge of each of said members exposed to an air flowstream flowing over said members is one of interrupted and non-linear throughout at least a portion of the length of each of said members, and said members have a wavy shape when viewed in a direction substantially normal to the direction of airflow over said members to reduce the formation of von Karman vortex streets generally at said trailing edges of said members.

14. A fan guard for a forced airflow air conditioning system, comprising:

plural spaced apart guard members each having a substantially cylindrical cross-section and a configuration such that at least one of a leading edge and trailing edge of each of said members exposed to an air flowstream flowing over said members is one of interrupted and non-linear throughout at least a portion of the length of each of said members, and said members include at least one of spaced apart rings and grooves interrupting a circumference of said members as presented to said air flowstream to reduce the formation of von Karman vortex streets generally at said trailing edges of said members.

15. A fan guard for a forced airflow air conditioning system, comprising:

plural spaced apart guard members each having a substantially cylindrical cross-section and a configuration such that at least trailing edge of each of said members exposed to an air flowstream flowing over said members is one of interrupted and non-linear and formed by a projection extending on a downstream side in the direction of flow of said air flowstream and throughout at least a portion of the length of each of said members to reduce the formation of von Karman vortex streets generally at said trailing edges of said members.

* * * * *